United States Patent [19]

Ramey

[11] 4,228,793

[45] Oct. 21, 1980

[54] PRESSURE-SWITCH OPERATED VIBRATING UNIT

[76] Inventor: Carol a.k.a. Carali Ramey, 1613-1/2 Ocean Front Walk, Playa del Rey, Calif. 90291

[21] Appl. No.: 972,284

[22] Filed: Dec. 22, 1978

Related U.S. Application Data

[63] Continuation-in-part of Ser. No. 737,797, Nov. 6, 1976, Pat. No. 4,136,685.

[51] Int. Cl.[3] ..... A61H 1/00

[52] U.S. Cl. ..... 128/33

[58] Field of Search ..... 128/33–36, 128/24.1, 24.2, 25 B

[56] References Cited

U.S. PATENT DOCUMENTS

| | | | |
|---|---|---|---|
| 2,096,646 | 10/1937 | Thornton-Norris | 128/25 B |
| 2,687,718 | 8/1954 | Britton et al. | 128/36 |
| 2,902,993 | 9/1959 | Wagner | 128/25 B |
| 3,115,139 | 12/1963 | Schneider | 128/36 X |
| 4,136,685 | 1/1979 | Ramey | 128/33 |

*Primary Examiner*—Lawrence W. Trapp
*Attorney, Agent, or Firm*—I. Morley Drucker

[57] ABSTRACT

The combination of an improved pressure-switch operated vibrating motor, enclosed either within a a cushioned housing or a non-cushioned housing. The improved pressure switch means comprises a combination of an enlarged pressure plate having a first, conductive element incorporated therein which, in its normal position is overlyingly spaced from a second conductive member located on a support means for the vibratory motor and a power source. Contact of the first and second conductive elements is readily made by application of compressive force to depress the pressure plate means and electrically interconnect the first and second conductive members, and engergize the motor. Release of the compressive force immediately de-energizes the vibratory motor. Incorporation of the pressure switch operating vibratory unit within a cushioned housing, as in a pillow or stuffed animal damps the vibrations and creates a useful vibratory pillow or toy item.

13 Claims, 10 Drawing Figures

PRESSURE-SWITCH OPERATED VIBRATING UNIT

CROSS-REFERENCE TO RELATED APPLICATIONS

This is a continuation-in-part application of copending application, Ser. No. 737,797 entitled "Cushioned Vibrating Means" filed Nov. 6, 1976, Carol (nmi) Ramey, Inventor and now U.S. Pat. No. 4,136,685.

BACKGROUND OF THE INVENTION

Hand-held motorized vibrators are well known for the purpose of relaxing and increasing blood circulation of the human body. However, to the best of my knowledge, cushioned motorized vibrators, designed to operate by virtue of the application of a person's pressure or weight, are not known, except as disclosed in the below referenced parent application.

The parent application disclosed a pressure-switch operated vibrating motor enclosed within a cushioning material using a leaf-spring switch which energizes a motor upon being depressed by an overlying pressure plate.

SUMMARY OF THE INVENTION

This invention is directed towards the combination of an improved and simplified pressure-switch operated vibrating motor, enclosed within a cushioning material, such as synthetic or natural foam, having an enlarged surface area relative to that of the motor. The pressure switch means comprises a preferably flexibly resilient pressure plate incorporating a first conductive element placed in directly overlying relationship with a second conductive element. The second conductive element is placed on a support plate member supporting the vibratory motor and power source. As a person applies pressure on said enlarged cushioning means, as by leaning on the cushion, the first and second conductive elements engage each other to close a circuit thereby energizing the vibrating motor enclosed within the cushioning means.

The pressure plate may be made of plastic and is greatly enlarged with respect to the conductive elements enabling pressure applied, at even remote parts of the cushioning material, to depress the pressure plate resulting in electrical contact of the conductive elements. To this end, the pressure plate is maintained in alignment relative to the second conductive contact, as by being pivotally mounted to the support plate member, and as pressure is placed on the cushioning means, the contacts will be engaged. Conversely, as pressure is released, the contacts will be readily disengaged.

The pressure switch means of this invention is simplified and made more economical in that a separate relatively expensive leaf spring switch is eliminated and replaced by the combination of an enlarged flexible resilient pressure plate having a first conductive element incorporated therein which, in its normal position, is spaced from a second conductive member located on a support means for said vibratory motor and power source. Contact of the first and second conductive elements is readily made by application of compressive force to depress the pressure plate means and electrically interconnect the first and second conductive members and energize the motor. Release of the compressive force immediately de-energizes the vibratory unit.

The vibrating motor causes the vibrations thereof to be transmitted to the cushioning material (which may be in the form of a pillow, stuffed toy, or the like) in a damped fashion and the entire surface of the cushioning commences to vibrate in a damped fashion. The vibrating unit may, in some applications, not be damped by cushioning means, and may be placed in a non-cushioned, but flexible housing.

DETAILED DESCRIPTION OF THE PREFERRED EMBODIMENT

Figure 1:
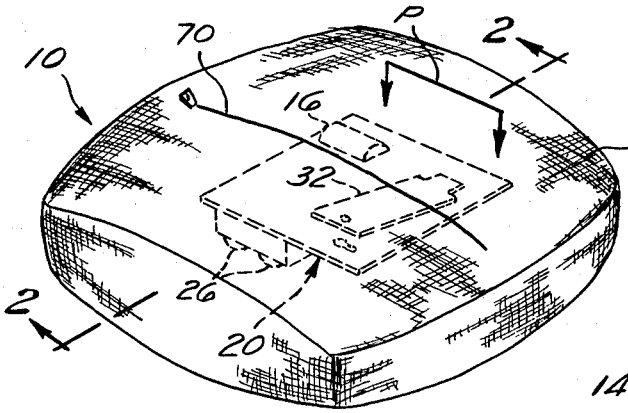
FIG. 1 shows a first embodiment of the invention in a typical cushion installation.
Figure 2:
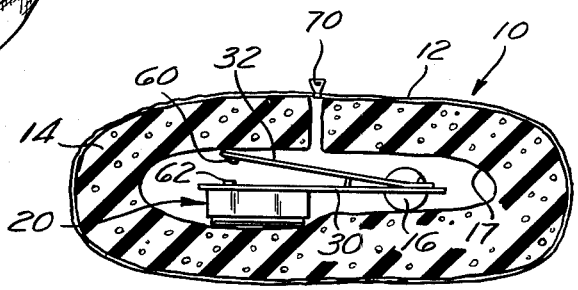
FIG. 2 is a cross-section taken along line 2—2 of FIG. 1.
Figure 3:
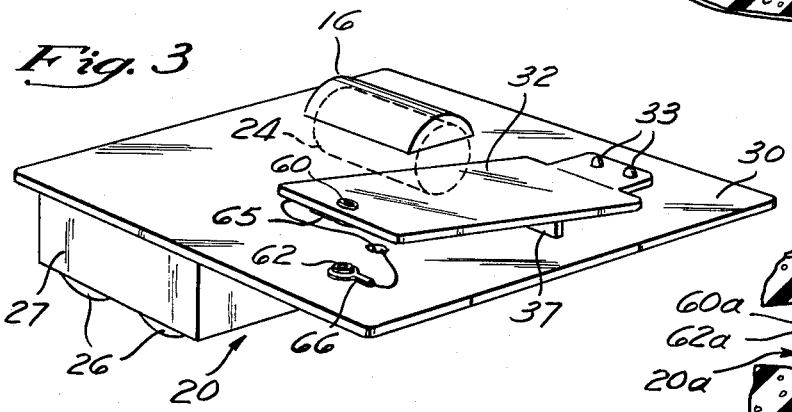
FIG. 3 is an enlarged perspective view of said first embodiment of the pressure-switch operated vibrating unit of this invention.

Referring particularly to FIGS. 1, 2 and 3, the cushioned vibrating means, or vibrating cushion is designated generally by the numeral 10. The vibrating cushion 10 comprises, preferably, a surface covering 12 made of fabric, plastic, reinforced plastic, or fur, and a form interior 14. The foam interior 14 is, preferably, made of a compressible synthetic foam (e.g., polyurethane) or a natural rubber foam material. A pocket 17 is formed in the foam material 14 for the insertion and complete enclosure of a pressure-switch operated motorized vibratory unit 20.

The vibratory unit 20 comprises, generally, a small vibrating motor 24 of conventional design, enclosed in a molded housing 16, and electrically connected, through a pressure switch means generally numbered 22, to a power source constituting, preferably, two or more series connected dry cell batteries 26. The motor 24, pressure switch means 22 and batteries 26 are stably mounted onto a rigid, preferably plastic support member or support plate 30.

The support plate 30 has, preferably molded therein, a battery case or housing 27.

Pressure switch means 22 includes a preferably flexibly resilient plastic pressure plate or sheet 32 incorporating an electrically conductive element 60, of relatively small surface area compared to the enlarged area of plate 32. Conductive element 60 directly overlies a second electrically conductive element 62 mounted onto support 30.

In order to maintain relative alignment of conductive element 60, 62 and assure energization of the motor, upon application of pressure to pressure plate 32, the plate 32 is preferably mounted at one end thereof, to support member 30, by pivot pins or rivets 33. The plate 32 is normally held in an acute angular relationship of between about 10°–20° with respect to support plate 30, by means of a spacer bar or member 37, preferably integrally formed on the underside of pressure plate 32.

In the embodiment of FIGS. 1, 2 and 3–6, both conductive elements 60 and 62 are brass rivets of conventional design to which are affixed conductive eyelet terminals 65, 66, respectively. The eyelet terminals 65, 66 are, in turn, electrically connected to the power source 26 and vibratory unit 24, via wiring 67.

The mechanical stability of the switch connections is an important consideration in the practice of this invention since the assembly is to be subjected to prolong periods of continuous vibration. While soldered connections would offer the requisite stability, they are less reliable electrically and would tend to add to the cost of manufacture of the device of the present invention.

Upon the application of an inwardly directed force as at P (see FIG. 1) upon cushion 10, the foam interior 14 is compressed and exerts pressure on pressure plate 32, which is thus depressed to bring the first conductive portion 60 of switch 22 into electrical contact with the second conductive portion 62 of switch means 22 to energize the vibrating motor 24. It is to be noted that pressure plate 32 lies in a position in which it can make unobstructed contact with the conductive switch element 62 upon application of force P upon the cushion 10. The motor 24 will immediately commence vibrating, upon depression of pressure plate 32, and the vibrations will be transmitted, in damped fashion over the entire exposed area of the cushion. Upon release of the inward force on the cushion 10, the preferably flexibly resilient pressure plate 32 reverts to the normal spaced position shown in FIG. 3 to thereby open the electrical circuit and de-energize the motor 24.

It will be understood by those skilled in the art that many variations of the invention are possible. For example, a pair of conductive elements (not otherwise electrically connected) may be mounted onto support plate 30 (not shown), and a third conductive element may be mounted to pressure plate means 32 so that said third conductive element overlies and interconnects said pair of conductive elements when the pressure plate 32 is depressed.

The cushion 10 may be attached to furniture, car seat or the like, or may be a wholly separate unit.

The motor unit 20 may be readily removed from cushion 10, by unfastening a zipper 70 sewn in fabric 12 or by other suitable means to allow access to the device and permit replacement of batteries 26 when needed.

Figure 2A:
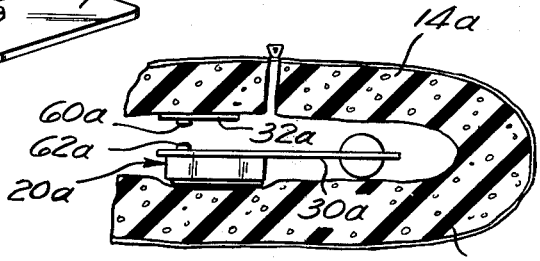
FIG. 2*a* is a cross-sectional view similar to FIG. 2 of a second embodiment of this invention.
Figure 4:
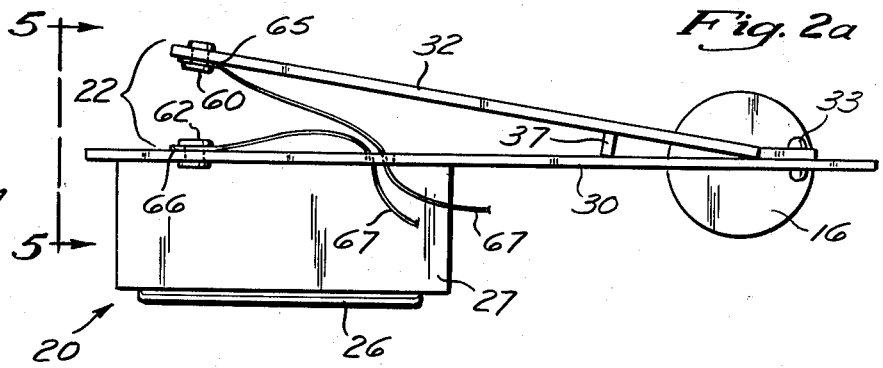
FIG. 4 is a side elevational view of the embodiment of FIG. 3.
Figure 5:
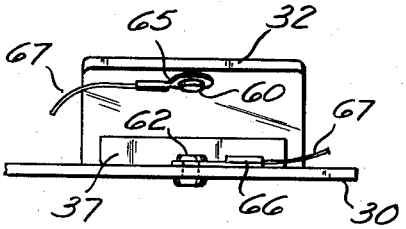
FIG. 5 is an elevational view of the pressure-switch operated vibrating unit taken along line 5—5 of FIG. 4.
Figure 6:
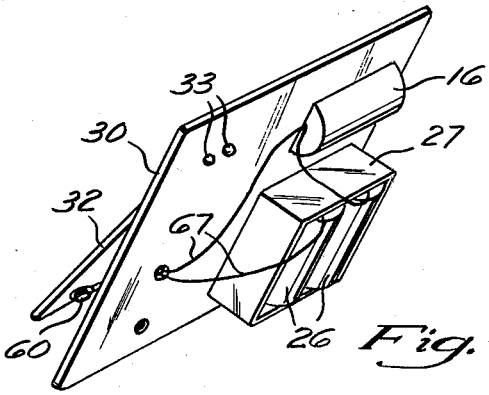
FIG. 6 is a perspective of the underside of the embodiment of FIG. 3.

It is also within the scope of this invention to maintain relative alignment of the conductive elements 60, 62 by adhesively mounting a pressure plate **32*a*, having a contact 60*a* incorporated therein to the cushioning material 14*a*, as shown in FIG. 2*a*. Contact 60*a* directly overlies electrical contact 62*a* mounted on support plate member 30*a* and is normally spaced from contact 62*a* because the cushioning material 14*a*, in its normal uncompressed state, will act as a spacer means to keep the contacts apart. Upon compression of foam 14*a*, however, the contacts 60*a*, 62*a* are readily electrically interconnected provided the vibratory unit 20*a*** is stably located in the cushioning means.

Figure 7:
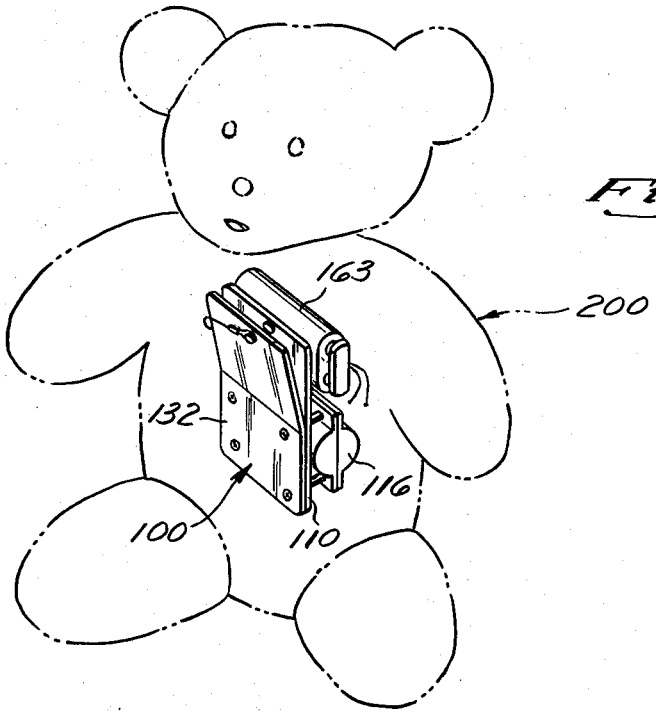
FIG. 7 is a perspective of a third embodiment of the pressure-sensitive operated vibrating unit of this invention installed within a stuffed or cushioned toy figure.
Figure 8:
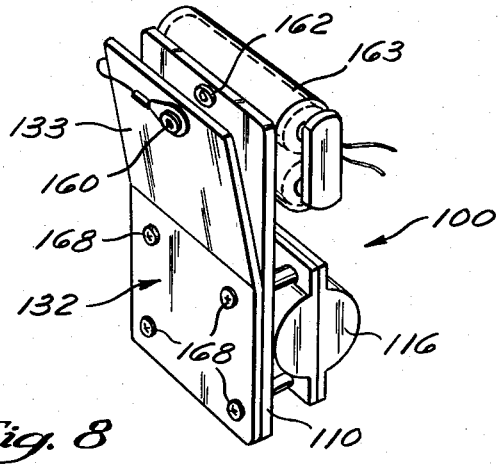
FIG. 8 is an enlarged perspective of the embodiment of FIG. 7.
Figure 9:
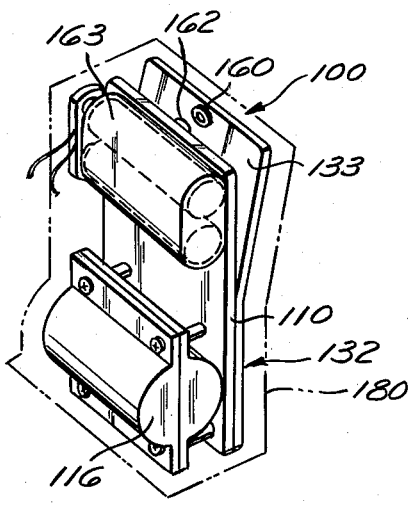
FIG. 9 is another perspective of the embodiment of FIG. 8 taken from the reverse side of FIG. 8.

A third embodiment of the vibrating means of this invention is shown in FIGS. 7–9 and is designated generally by the numeral 100. The FIGS. 7–9 embodiment is especially adapted for small pillows or use in a stuffed toy animal 200. In this third embodiment, the support plate member 110 has been reduced in size, compared to the support member 30, **30*a* of FIGS. 1–6 and is now of similar size to an attached pressure plate member 132. The support member 110 carries, on one side thereof, the vibratory unit 116 and power source 163 therefor. The pressure plate 132 is affixed to the opposite surface of the support member 110 by means of screws 168, or the like mounted in one end only so that a flexible, resilient flap portion or member 133 is formed, bent away from support member 110, so as to be normally spaced therefrom. Flap 133 has electrical contact 160 affixed thereto in directly overlying relationship with contact 162 of support member 110. The bending of flap 133 serves as the spacer means normally spacing the contacts 160, 162** apart in this embodiment.

The vibratory unit 100 is more compact than unit 10 and is particularly suitable for certain applications, such as installation inside the small stuffed toy animal 200. Although such stuffed three dimensional figures conform generally to the structure of a pillow or cushion means, the applicant intends that such three dimensional figures be included within the term cushioned vibrating means as used throughout this specification and claims.

The compact unit 100 may also be placed within a non-cushioned housing for other applications, as shown in phantom line 180 of FIG. 9, where non-damped vibratory action is desired.

Modifications of the foregoing will become apparent to those skilled in the art. However, I intend to be bound only by the scope of the claims which follow.

We claim:

1. A vibratory unit which comprises:

a vibratory motor means;

a portable power source;

a support member for supporting said motor means and power source;

a first electrically conductive member affixed to said support member;

a pressure plate means having a second electrically conductive member affixed thereto, said pressure plate means being enlarged with respect to both said first and second conductive members;

means for electrically interconnecting said power source and vibratory means to said first and second conductive members for energization of said vibratory motor means upon electrical interconnection of said first and second conductive members; and spacer means for maintaining said conductive element of said pressure plate means in normally spaced, overlying alignment with respect to said first conductive member whereby upon application of inwardly directed force onto said pressure plate means, said first and second conductive members are electrically interconnected to energize said vibratory motor means and upon release of said inwardly directed force said vibratory motor means is de-energized.

2. The vibratory unit of claim 1 wherein said pressure plate means is pivotally mounted to said support member.

3. The vibratory unit of claim 1 wherein said pressure plate means is pivotally mounted to said support member and said spacer means is located between said pressure plate means and said support member to maintain a space between said first and second conductive members in the absence of compressive force directed upon said pressure plate means and said support member.

4. The vibratory unit of claim 1 wherein said vibrating unit is completely enclosed within a cushioned housing and said spacer means is the cushioning of the said cushioned housing and said pressure plate is affixed to an inner surface of said cushioning housing.

5. The vibratory unit of claim 1 wherein said pressure plate means comprises a flexibly resilient plastic sheet.

6. The vibratory unit of claim 1 wherein said vibratory motor means and portable power source are supported on one side of said support means, and said pressure plate means is affixed to the opposite side of said support member.

7. The vibratory unit of claim 1 wherein said vibratory unit is completely enclosed within a cushioned housing.

8. The vibratory unit of claim 1 wherein said vibratory unit is completely enclosed within a non-cushioned housing.

9. A cushioned vibrating means, which comprises:

a vibratory motor means;

a portable power source;

switching means electrically connected to said vibratory motor means, and to said portable power source for energization and de-energization of said vibratory motor means, including an enlarged pressure plate means having affixed thereto a first conductive portion, a support member having a second conductive portion and said first and second conductive portions being in overlying normally spaced, alignment with each other; and a compressible cushioning material completely enclosing said vibratory motor means, portable power source, and said switching means whereby upon the application of external inwardly directed force at any one of a multiplicity of areas on the surface of said compressible cushioning material said pressure plate means is depressed bringing said first conductive portion of said switching means into contact with said second conductive portion of said switching means, to thereby energize said vibratory motor means for transmission of vibrations, in a damped manner, to the surface of said cushioning material and upon release of said external inwardly directed force upon said compressible cushioning material said pressure plate means is released so as to disengage said first and second conductive portions of said switching means to thereby de-energize said vibratory motor means.

10. The vibratory unit of claim 9 wherein said pressure plate means is pivotally mounted to said support member.

11. The vibratory unit of claim 9 wherein said pressure plate means is pivotally mounted to said support member and a spacer means is located between said pressure plate means and said support member to maintain a space between said first and second conductive portions in the absence of compressive force directed upon said pressure plate means and said support member.

12. The vibratory unit of claim 9 wherein said pressure plate means comprises a flexibly resilient plastic sheet.

13. The vibratory unit of claim 9 wherein said vibratory motor means and portable power source are supported on one side of said support means, and said pressure plate means is affixed to the opposite side of said support member.

* * * * *